United States Patent [19]

Nobel

[11] Patent Number: 4,465,563

[45] Date of Patent: Aug. 14, 1984

[54] ELECTRODEPOSITION OF PALLADIUM-SILVER ALLOYS

[75] Inventor: Fred I. Nobel, Sands Point, N.Y.

[73] Assignee: LeaRonal, Inc., Freeport, N.Y.

[21] Appl. No.: 452,144

[22] Filed: Dec. 22, 1982

[51] Int. Cl.[3] ..... C25D 3/56

[52] U.S. Cl. ..... 204/43 N

[58] Field of Search ..... 204/43 R, 43 N, 123

[56] References Cited

U.S. PATENT DOCUMENTS

| | | | |
|---|---|---|---|
| 905,837 | 12/1908 | Broadwell | 204/55 R |
| 2,195,409 | 4/1942 | Flett | 204/46 G |
| 2,525,942 | 10/1950 | Proell | 204/45 R |
| 3,053,741 | 9/1962 | Medina | 204/43 N |
| 3,905,878 | 9/1975 | Dohi et al. | 204/43 S |
| 4,098,656 | 7/1978 | Deuber | 204/47 |
| 4,132,610 | 1/1979 | Dohi et al. | 204/43 S |
| 4,242,180 | 12/1980 | Heppner | 204/43 N |
| 4,246,077 | 1/1981 | Hradil et al. | 204/43 R |
| 4,269,671 | 5/1981 | Cohen et al. | 204/23 |

FOREIGN PATENT DOCUMENTS

| | | | |
|---|---|---|---|
| 440591 | 4/1947 | Canada | 204/43 R |
| 72167 | 4/1970 | Fed. Rep. of Germany | 204/43 R |
| 38-19825 | 9/1963 | Japan | 204/43 R |
| 57-143485 | 4/1982 | Japan | 204/43 R |
| 221452 | 4/1973 | U.S.S.R. | 204/43 R |
| 379676 | 4/1973 | U.S.S.R. | 204/43 R |

OTHER PUBLICATIONS

N. Dohi et al., "Electrodeposition of Bright Tin-Lead Alloys from Alkanol Sulfonate Bath", Interfinish 80, (1980).

N. Dohi et al., Proceedings of Electroplating Seminars, Showa 53, Jul. 7, 1978.

Larissa Domnikov, Metal Finishing, pp. 58-65, Sep. 1969.

"Bath for the Preparation of Silver-Palladium Alloys'-'-IBM Technical Disclosure Bulletin vol. 7, No. 3, p. 177, 8/64.

*Primary Examiner*—G. L. Kaplan

*Attorney, Agent, or Firm*—Pennie & Edmonds

[57] ABSTRACT

Aqueous electroplating solutions for the electrodeposition of palladium-silver alloys comprising a soluble palladium compound, a soluble silver compound and water soluble organo sulfonic acid in an amount sufficient to maintain the palladium and silver compounds in solution and process for electrolytically plating palladium-silver alloys.

13 Claims, No Drawings

ELECTRODEPOSITION OF PALLADIUM-SILVER ALLOYS

FIELD OF THE INVENTION

The invention relates to the electrodeposition of palladium-silver alloys and to electrolytic solutions containing the alloying metals palladium and silver from which the alloys are deposited.

BACKGROUND OF THE INVENTION

Palladium-silver alloys have many uses. They are particularly useful in the electronic field as electrical contacts and connectors in place of pure gold or pure palladium. No process is known today, to the applicant's knowledge, which is capable of electrolytically plating palladium-silver alloys from an electrolytic plating solution from a practical or commercial standpoint. Palladium-silver alloys are presently used as electrical contacts or connectors in the form of wrought alloys. These alloys have also been prepared for use as electrical contacts or connectors by first plating pure palladium and then pure silver onto the desired surface from separate electroplating solutions and separate deposits fused by heat to form the alloy. One of the reasons why no practical or commercial electroplating process is available for depositing palladium-silver alloys is that the plating potential of palladium ions and silver ions is too far apart so that no single plating potential will permit the deposition of both metals at the same time to form a sound deposit. It would obviously be an advantage to the industry if electrical contacts or connectors could be directly electrolytically plated with the desired palladium-silver alloy.

SUMMARY OF THE INVENTION

This invention relates to aqueous electroplating solutions containing palladium and silver and an organo sulfonic acid capable of keeping both the palladium and silver in solution. This combination surprisingly results in bringing the plating potential of each metal sufficiently close together so that a single potential is capable of simultaneous deposition of both the palladium and silver metals to form alloy deposits.

DETAILED DESCRIPTION OF THE INVENTION

The organo sulfonic acids that can be used according to the invention include alkane sulfonic acids, aryl sulfonic acids and alkane aryl sulfonic acids. The organic sulfonic acids can contain one or a plurality of sulfonic acid groups. More specific examples include alkane sulfonic acids having between 1 and 5 carbon atoms in the alkyl group, such as methane sulfonic acid, phenol sulfonic acid and toluene sulfonic acid. The organo sulfonic acids can also contain other functional groups, such as alkanol sulfonic acids, e.g., propanol sulfonic acids. The only limiting criteria known today with respect to the scope of organo sulfonic acids that can be used is that they should have sufficient water solubility to keep the palladium and silver compounds in solution and render plating potentials of palladium and silver sufficiently close to enable the plating of both metals simultaneously to produce an alloy deposit. The organo sulfonic acids are well known and have been used in electrolytic plating solutions. See, for example, U.S. Pat. Nos. 2,525,942; 2,195,409; 905,837; 3,905,878; 4,132,610; INTERFINISH 80, "Electrodeposition of Bright Tin-lead Alloys From Alkanolsulfonate Bath", by N. Dohi and K. Obata; Industrial Research Institute of Hyogo Pref. Kobe, Japan; and Proceeding of Electroplating Seminars, Showa 53, July 7, 1978, by N. Dohi and K. Kohata, "Bright Solder and Indium Plating from Methane Sulfonic Acid". All of the above disclosures are incorporated herein by reference.

The palladium and silver can be added to the solution in various forms so long as they are soluble in the electroplating solutions and do not cause precipitation. Examples of compounds that can be employed in the solutions include palladium diamino dinitrite (P-salt), palladium nitrate, palladium sulfate and the organo sulfonic acid salts of palladium. Silver can be added as silver nitrate, silver sulfate or as an organo sulfonic acid silver salt.

The amount of organo sulfonic acid should be sufficient to produce the desired alloys. It is generally recommended that the concentration of the organo sulfonic acid be in excess of about 50 ml/l or g/l; 100 to 300 ml/l or g/l is preferable, but amounts higher than 300 ml/l or g/l can be used if desired.

The temperature of the bath during deposition should be sufficient to maintain the palladium and silver in solution. The particular temperature employed to accomplish this objective will depend upon amounts of silver and/or palladium in the solution, the amount of sulfonic acid, the particular palladium and/or silver salts being used, etc., and can be readily determined by routine experimentation. Generally a bath temperature of 175° F. has been found to be sufficient in most cases.

The anode is preferably platinum plated titanium which is commonly used in plating pure palladium. The cathode can be of most any base metal, but it is preferred to initially plate the base metal cathode with a thin coating of a noble metal, or a noble metal alloy, preferably silver or gold or palladium to protect the base metal cathode from initial attack before the palladium-silver alloy plating begins and to prevent the silver and/or palladium content in the solution from plating by immersion (electroless plating) on the base metal cathode.

The palladium to silver ratio will, of course, vary depending on the alloy desired. Advantageously the palladium to silver ratio, as metal, should be in excess of about 6 to 1. A palladium to silver ratio of 12 to 1 can advantageously be used to produce an acceptable alloy. As the ratio to silver metal is increased, the amount of silver content in the deposited alloy is slightly lowered. For example, using a palladium to silver ratio of 24 to 1 produces an acceptable alloy but the silver content is a little lower than those alloys obtained using a ratio of about 12 to 1.

EXAMPLE 1

12 g/l of palladium metal as palladium diamino dinitrite together with 1 g/l of silver metal as silver nitrate contained in a 0.1 N aqueous solution were mixed with 200 ml/l of 100% methane sulfonic acid. The palladium diamino dinitrite is first added to the methane sulfonic acid. When this palladium salt is added, gassing occurs, which eventually stops, and the palladium salt is then in solution. The silver nitrate is then introduced into the solution and water is added to form the required volume. The solution is then heated to about 175° F. Using the anode and plated base metal cathode as described above, a palladium-silver alloy containing 54% palladium and 46% silver was plated at 2 amps per square foot under mild agitation. At 20 asf an alloy was deposited containing 61% palladium and 39% silver. The deposited alloys were sound, semi-bright deposits.

EXAMPLE 2

Example 1 was repeated using palladium nitrate and 300 ml/l of methane sulfonic acid. A sound, semi-bright silver alloy was deposited at 2 asf.

EXAMPLE 3

Example 1 was repeated substituting 500 ml/l of a 65% aqueous solution of phenol sulfonic acid. Sound, semi-bright palladium-silver alloys were deposited at 2 asf and 5 asf.

EXAMPLE 4

Example 1 was repeated substituting 300 g/l of toluene sulfonic acid (monohydrate) for the methane sulfonic acid and palladium sulfate for the palladium diamino dinitrite. Sound silver-gray alloys were deposited at 2 and 5 asf.

EXAMPLE 5

Example 1 was repeated using 300 ml/l of methane sulfonic acid and adding the palladium and silver metals as the methane sulfonic acid salts and diluting the solutions with water to form the required volume. Good plated palladium-silver alloys were obtained at 2, 5 and 15 asf.

Best results to date have been obtained using palladium diamino dinitrite. When palladium compounds other than palladium diamino dinitrite are employed, a small amount, e.g., about 5 g/l of a nitrite salt, such as sodium nitrite, has been found to improve the current density range of the plating solutions. The exact or optimum amounts of the nitrite salts which can be added have not been determined, but this information can readily be obtained by routine experimentation. Large amounts of the nitrite salt, e.g. about 15 g/l, have so far been found to reduce the cathode efficiency.

I claim:

1. An aqueous electroplating solution for the electrodeposition of palladium-silver alloys comprising a soluble palladium compound, a soluble silver compound and water soluble organo sulfonic acid in an amount sufficient to maintain the palladium and silver compounds in solution.

2. The aqueous solution of claim 1 in which the palladium compound is palladium diamino dinitrite.

3. The aqueous plating solution of claim 2 in which the organo sulfonic acid is an alkane sulfonic acid.

4. The aqueous solution of claim 1 which contains a sufficient amount of a nitrite salt to improve the current density range of the plating solution.

5. The aqueous solution of claim 4 in which the organo sulfonic acid is an alkane sulfonic acid.

6. The aqueous solution of claim 1 which contains a palladium to silver ratio, as metal, of at least about 6 to 1.

7. The aqueous solution of claim 6 in which the organo sulfonic acid is in excess of about 50 m/l or g/l.

8. A process for electrolytically plating palladium-silver alloys which comprises electrolyzing an aqueous solution containing a soluble palladium compound, a soluble silver compound and a water soluble organo sulfonic acid in an amount sufficient and at a temperature sufficient to maintain the palladium and silver compound in solution.

9. The process according to claim 8 in which the cathode is comprised of a base metal coated with a noble metal in a sufficient amount to prevent silver immersion plating thereon.

10. The process according to claim 8 in which the palladium compound is palladium diamino dinitrite.

11. The process according to claim 8 in which the electrolytic solution contains a sufficient amount of a nitrite salt to improve the current density range of the plating solution.

12. The process according to claim 8 in which the palladium to silver ratio, as metal, is at least about 6 to 1.

13. The process according to claim 12 in which the organo sulfonic acid is in excess of about 50 ml/l or g/l.

* * * * *